US007042326B2

(12) United States Patent
Gau

(10) Patent No.: US 7,042,326 B2
(45) Date of Patent: May 9, 2006

(54) SYMMETRICAL INDUCTOR

(75) Inventor: Jing-Horng Gau, Hsin-Chu Hsien (TW)

(73) Assignee: United Microelectronics Corp., Hsin-Chu (TW)

( * ) Notice: Subject to any disclaimer, the term of this patent is extended or adjusted under 35 U.S.C. 154(b) by 180 days.

(21) Appl. No.: 10/707,771

(22) Filed: Jan. 11, 2004

(65) Prior Publication Data

US 2005/0151612 A1 Jul. 14, 2005

(51) Int. Cl.
*H01F 5/00* (2006.01)

(52) U.S. Cl. ..... 336/200

(58) Field of Classification Search ..... 336/200, 336/206–208, 223, 232; 257/531
See application file for complete search history.

(56) References Cited

U.S. PATENT DOCUMENTS 6,867,677 B1 * 3/2005 Nielson ..... 336/200
6,967,555 B1 * 11/2005 Yu et al. ..... 336/200
6,972,658 B1 * 12/2005 Findley et al. ..... 336/200
2004/0217839 A1 * 11/2004 Haaren et al. ..... 336/200

* cited by examiner

*Primary Examiner*—Tuyen T Nguyen
(74) *Attorney, Agent, or Firm*—Winston Hsu

(57) ABSTRACT

A symmetrical inductor includes a first metal layer, the first metal layer having a first conductive segment disposed on a first side of a line, and a second conductive segment disposed on a second side of the line, the second conductive segment and the first conductive segment being symmetrical to the line; a second metal layer, the second metal layer having a third conductive segment disposed on the first side of the line, and a fourth conductive segment disposed on the second side of the line, the fourth conductive segment and the third conductive segment being symmetrical to the line; a first contact plug for connecting the first conductive segment with a first end of the third conductive segment; a second contact plug for connecting the first conductive segment with a second end of the third conductive segment; a third contact plug for connecting the second conductive segment with a first end of the fourth conductive segment, the third contact plug and the first contact plug being symmetrical to the line; and a fourth contact plug for connecting the second conductive segment with a second end of the fourth conductive segment, the fourth contact plug and the second contact plug being symmetrical to the line.

9 Claims, 4 Drawing Sheets

SYMMETRICAL INDUCTOR

BACKGROUND OF INVENTION

1. Field of the Invention

The present invention relates to an inductor, and more particularly, to a symmetrical inductor.

2. Description of the Prior Art

An inductor is a passive electronic component that stores energy in the form of a magnetic field, and an inductor tends to resist any change in the amount of current flowing through it. The inductor is usually used with capacitors in various wireless communications applications for providing stable currents, switched phases, filtering and resonance. In its simplest form, the inductor consists of a wire loop or coil. The inductance is directly proportional to the number of turns, the thickness, the length and the radius of the coil. The inductance also depends on the type of material around which the coil is wound. In a semiconductor manufacturing process, at least two metal layers with specifically designed layout patterns and a plurality of contact plugs for connecting these two metal layers are used to form a wire loop, thus fabricating an inductor onto an integrated circuit chip.

Referring to FIG. 1, FIG. 1 is a schematic diagram of an inductor according to the prior art. As shown in FIG. 1, a differential inductor 10 includes a first metal layer, which consists of a first conductive segment 12 and a second conductive segment 14. The first conductive segment 12 and the second conductive segment 14 are interlaced with each other to form an approximate circle pattern with two overlapping regions A and B. The inductor 10 further includes a second metal layer, which consists of a third conductive segment 20 and a fourth conductive segment 24. The third conductive segment 20 is disposed under the overlapping region A of the first conductive segments 12 and the second conductive segment 14, and the fourth conductive segment 24 is disposed under the overlapping region B of the first conductive segments 12 and the second conductive segment 14. The inductor 10 further includes a dielectric layer (not shown) disposed between the first metal layer and the second metal layer, and a plurality of contact plugs 16, 18, 22, 26 penetrating through the dielectric layer to connect the first metal layer and the second metal layer. For example, the portions of the second conductive segment 14 and the third conductive segment 20 at the overlapping region A are connected with each other via the contact plugs 16 and 18. The portions of the first conductive segment 12 and the fourth conductive segment 24 at the overlapping region B are connected with each other via the contact plugs 22 and 26.

The inductor 10 cannot provide a symmetrical structure at the overlapping regions of the first conductive segment 12 and the second conductive segment 14. For example, at the overlapping region A, the second conductive segment 14 connects to the third conductive segment 20 via the contact plugs 16, 18, however, the first conductive segment 12 does not need any contact plugs to connect to the second metal layer. At the overlapping region B, the first conductive segment 12 connects to the fourth conductive segment 24 via the contact plugs 22, 26, however, the second conductive segment 14 does not need any contact plugs to connect to the second metal layer. In this case, different parasitic resistance values occur in the asymmetrical inductor 10, and two differential signals (V+, V−) at the two ends of the inductor 10 become asymmetrical to result in phase differences and phase noises, thus deeply affecting the electronic circuit characteristics.

SUMMARY OF INVENTION

It is therefore an object of the claimed invention to provide a symmetrical inductor to solve the above-mentioned problems.

According to the claimed invention, the symmetrical inductor includes a first metal layer, the first metal layer having a first conductive segment disposed on a first side of a line, and a second conductive segment disposed on a second side of the line, the second conductive segment and the first conductive segment being symmetrical to the line; a second metal layer, the second metal layer having a third conductive segment disposed on the first side of the line, and a fourth conductive segment disposed on the second side of the line, the fourth conductive segment and the third conductive segment being symmetrical to the line; a first contact plug for connecting the first conductive segment with a first end of the third conductive segment; a second contact plug for connecting the first conductive segment with a second end of the third conductive segment; a third contact plug for connecting the second conductive segment with a first end of the fourth conductive segment, the third contact plug and the first contact plug being symmetrical to the line; and a fourth contact plug for connecting the second conductive segment with a second end of the fourth conductive segment, the fourth contact plug and the second contact plug being symmetrical to the line.

It is an advantage of the present invention to design layout patterns of the inductor into a fully symmetrical structure. The first conductive segment and the second conductive segment of the first metal layer are disposed at either side of the line and symmetrical to the line. The third conductive segment and the fourth conductive segment of the second metal layer are disposed at either side of the line and symmetrical to the line. In addition, the contact plugs symmetrical to the line are also used to connect the first metal layer and the second metal layer. Therefore, the fully symmetrical inductor of the present invention can effectively prevent the problems of different parasitic resistance values, asymmetrical signals, phase differences and phase noises.

These and other objects of the claimed invention will be apparent to those of ordinary skill in the art after reading the following detailed description of the preferred embodiment that is illustrated in the various figures and drawings.

DETAILED DESCRIPTION

Figure 1:
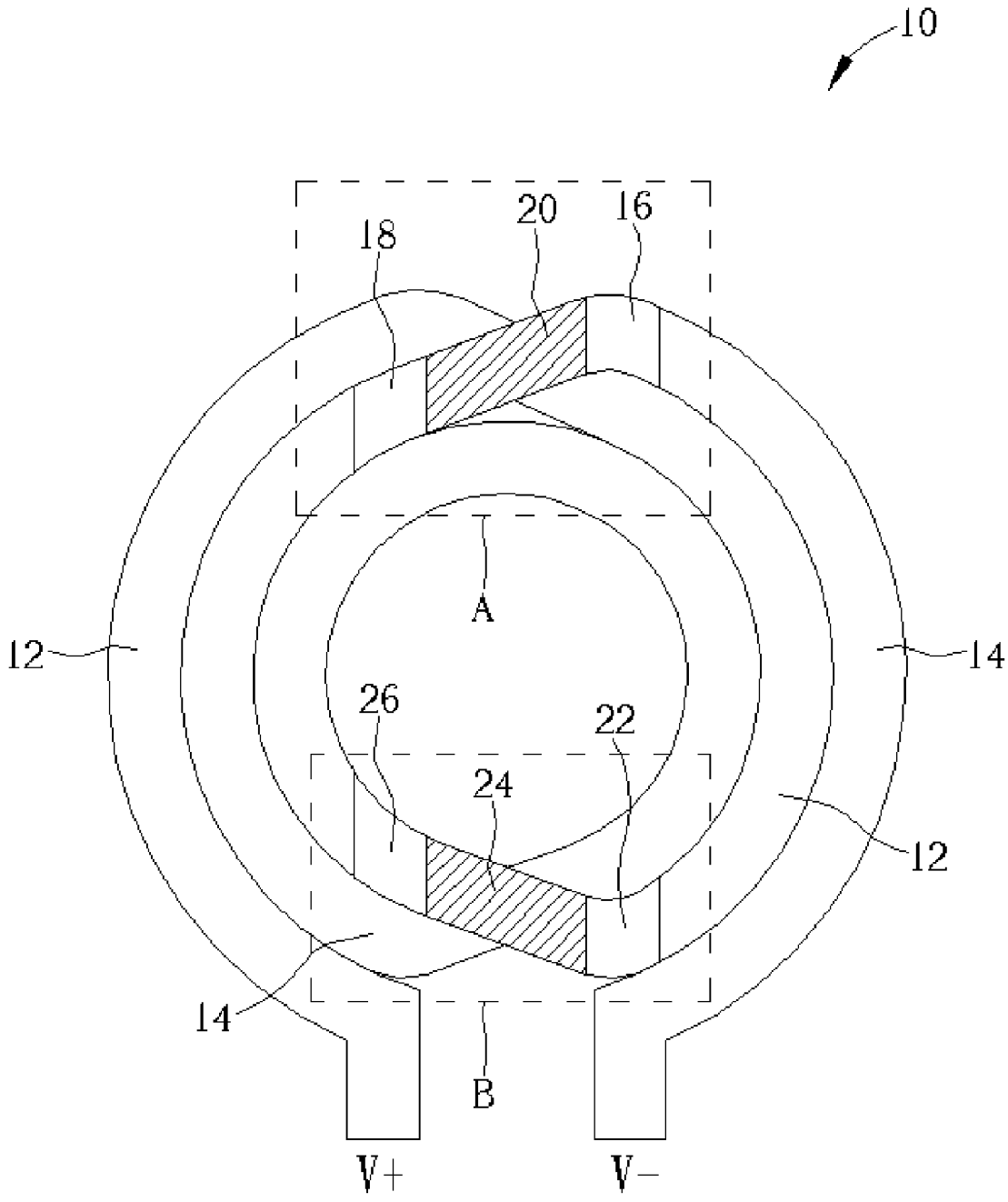
Fig. 1 Prior art
FIG. 1 is a schematic diagram of an inductor according to the prior art.
Figure 2:
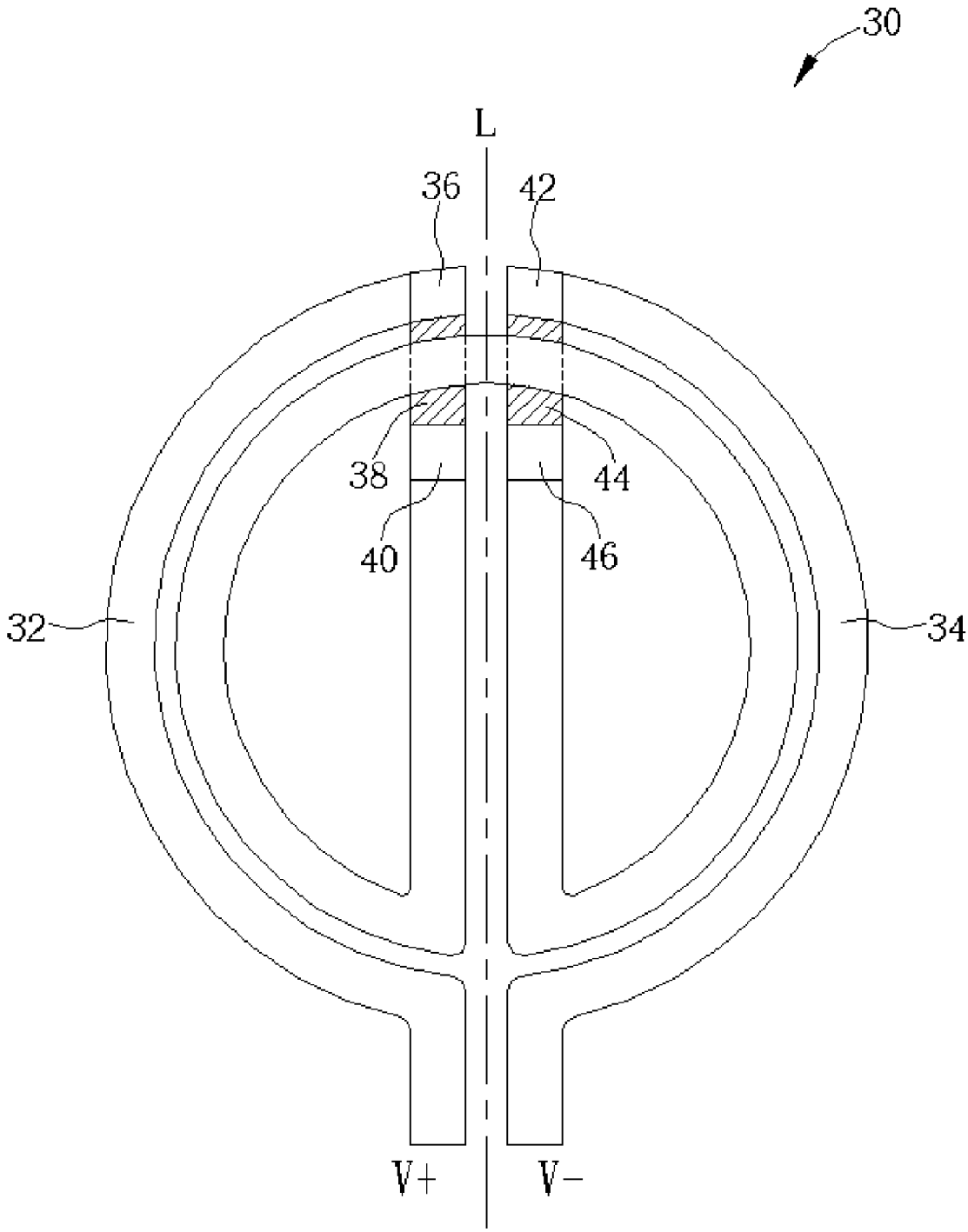
FIG. 2 is a schematic diagram of an inductor according to a first embodiment of the present invention.

Referring to FIG. 2, FIG. 2 is a schematic diagram of an inductor according to a first embodiment of the present invention. As shown in FIG. 2, a differential inductor 30 includes a first metal layer, which consists of a spiral-shaped first conductive segment 32 and a spiral-shaped second conductive segment 34 symmetrical to a line L. The first conductive segment 32 and the second conductive segment 34 form at least an approximate circle pattern, and the line L is a diameter of the circle pattern. The inductor 30 further includes a second metal layer, which consists of a third conductive segment 38 and a fourth conductive segment 44 symmetrical to the line L. A portion of the first conductive segment 32 is disposed above the third conductive segment 38, and a portion of the second conductive segment 34 is disposed above the fourth conductive segment 44. Alternatively, in other embodiments of the present invention, the second metal layer is disposed above the first metal layer. As a result, a portion of the first conductive segment 32 is disposed under the third conductive segment 38, and a portion of the second conductive segment 34 is disposed under the fourth conductive segment 44. The inductor 30 further includes at least a dielectric layer (not shown) disposed between the first metal layer and the second metal layer, and a plurality of contact plugs 36, 40, 42, 46 penetrating through the dielectric layer to connect the first metal layer and the second metal layer. For example, the first conductive segment 32 comprises at least a first contact point and a second contact, and the second conductive segment 34 comprises at least a third contact point and a fourth contact point. The first contact point of the first conductive segment 32 and the third contact point of the second conductive segment 34 are symmetrical to the line L. The second contact point of the first conductive segment 32 and the fourth contact point of the second conductive segment 34 are symmetrical to the line L, too. The contact plug 36 connects the first contact point of the first conductive segment 32 to a first end of the third conductive segment 38. The contact plug 40 connects the second contact point of the first conductive segment 32 to a second end of the third conductive segment 38. The contact plug 42 connects the third contact point of the second conductive segment 34 to a first end of the fourth conductive segment 44. The contact plug 46 connects the fourth contact point of the second conductive segment 34 to a second end of the fourth conductive segment 44.

Since the patterns of the first metal layer, the second metal layer and the contact plugs connecting the first metal layer and the second metal layer are symmetrical to the line, the inductor of present invention provides a fully symmetrical structure for the two differential signals (V+, V−) to improve the quality of the inductor and prevent the problems of phase noises. In addition, the present invention may further design rounded corners in the first conductive segment and the conductive segment of the first metal layer, thus preventing currents flowing through the inductor from collecting at the corners to increase local resistance and reduce the quality factor of the inductor. It is worth noticing that the inductor of the present invention is not limited to have the approximate circle pattern. Other inductor patterns comprising a plurality of metal layers, conductive segments and contact plugs symmetrical to a certain line are all applicable in the present invention.

Figure 3:
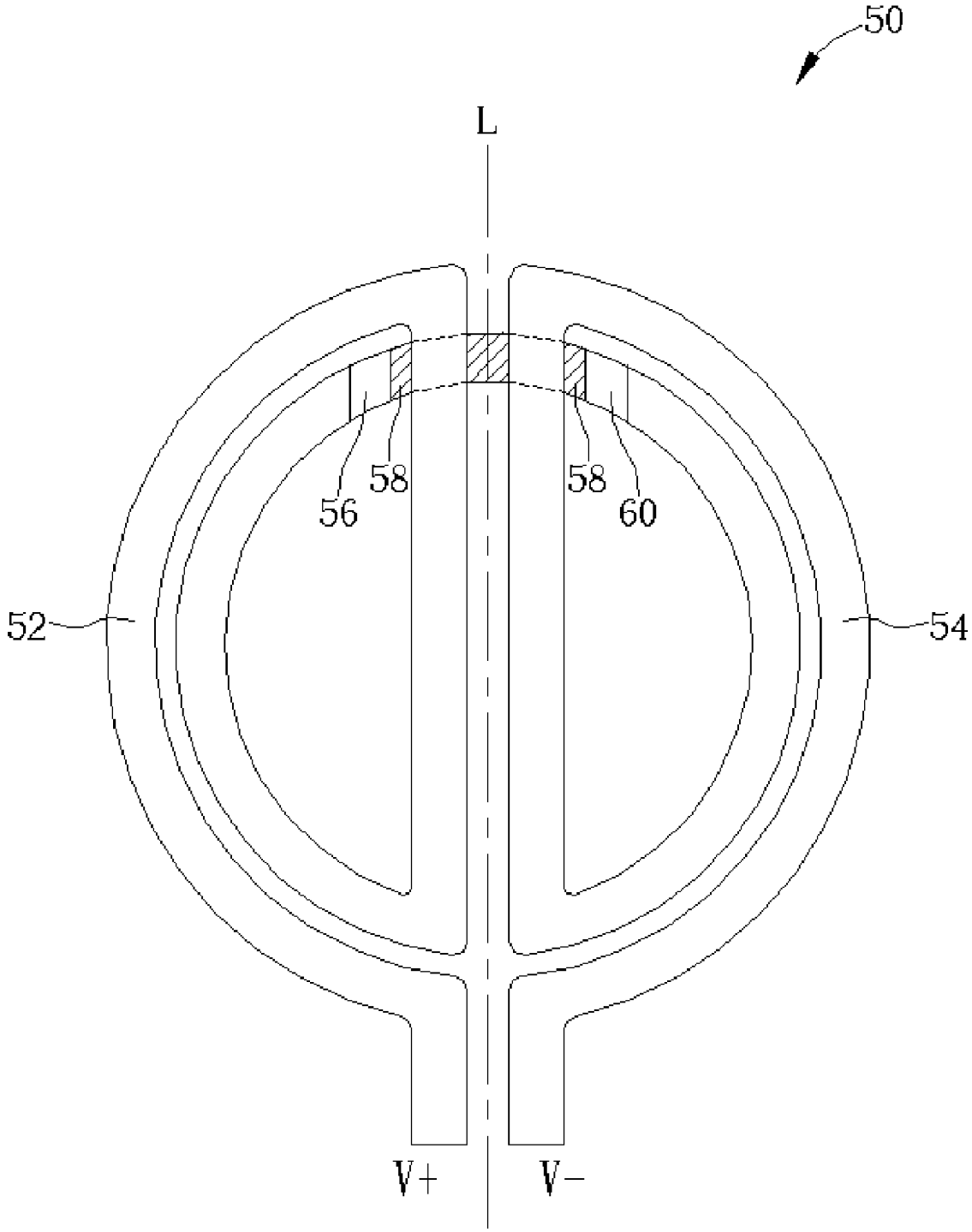
FIG. 3 is a schematic diagram of an inductor according to a second embodiment of the present invention.

Referring to FIG. 3, FIG. 3 is a schematic diagram of an inductor according to a second embodiment of the present invention. As shown in FIG. 3, a differential inductor 50 includes a first metal layer, which consists of a spiral-shaped first conductive segment 52 and a spiral-shaped second conductive segment 54 symmetrical to a line L. The first conductive segment 52 and the second conductive segment 54 form at least an approximate circle pattern, and the line L is a diameter of the circle pattern. The inductor 50 further includes a second metal layer 58, and at least a dielectric layer (not shown) disposed between the second metal layer 58 and the first metal layer 52, 54. Portions of the first conductive segment 52 and the second conductive segment 54 are disposed above the second metal layer 58. Alternatively, in other embodiments of the present invention, the second metal layer 58 is disposed above the first metal layer 52, 54. As a result, portions of the first conductive segment 52 and the second conductive segment 54 are disposed under the second metal layer 58. The inductor 50 further includes a plurality of contact plugs 56, 60 penetrating through the dielectric layer to connect the first metal layer 52, 54 and the second metal layer 58. For example, the first conductive segment 52 comprises at least a first contact point, and the second conductive segment 54 comprises at least a second contact point. The first contact point of the first conductive segment 52 and the second contact point of the second conductive segment 54 are symmetrical to the line L. The contact plug 56 connects the first contact point of the first conductive segment 52 to a first end of the second metal layer 58. The contact plug 60 connects the second contact point of the second conductive segment 54 to a second end of the second metal layer 58.

Since the patterns of the first metal layer, the second metal layer and the contact plugs connecting the first metal layer and the second metal layer are symmetrical to the line, the inductor of present invention provides a fully symmetrical structure for the two differential signals (V+, V−) to improve the quality of the inductor and prevent the problems of phase noises. In addition, the present invention may further design rounded corners in the first conductive segment and the conductive segment of the first metal layer, thus preventing currents flowing through the inductor from collecting at the corners to increase local resistance and reduce the quality factor of the inductor. It is worth noticing that the inductor of the present invention is not limited to have the approximate circle pattern. Other inductor patterns comprising a plurality of metal layers, conductive segments and contact plugs symmetrical to a certain line are all applicable in the present invention.

Figure 4:
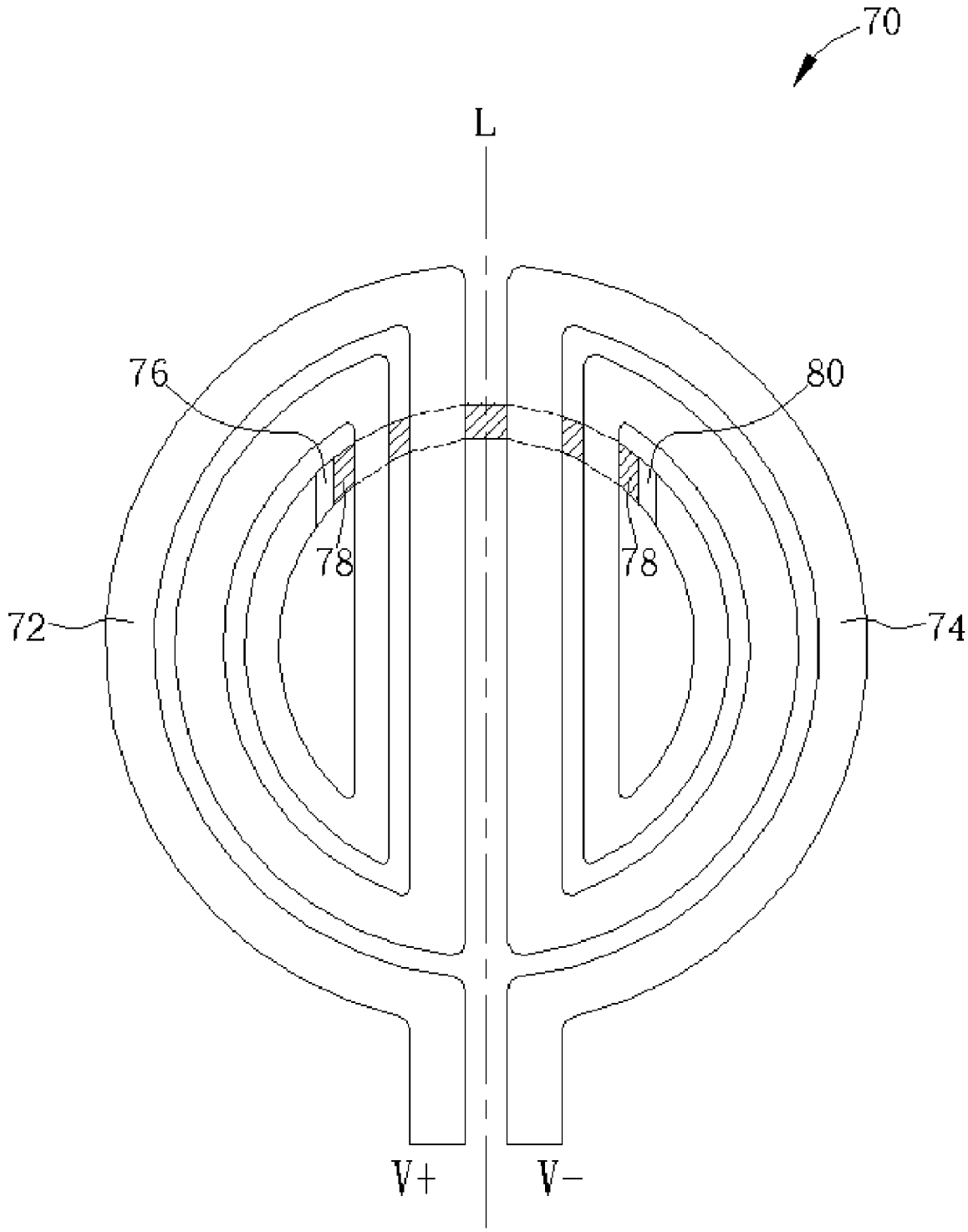
FIG. 4 is a schematic diagram of an inductor according to a third embodiment of the present invention.

Referring to FIG. 4, FIG. 4 is a schematic diagram of an inductor according to a third embodiment of the present invention. As shown in FIG. 4, a differential inductor 70 includes a first metal layer, which consists of a spiral-shaped first conductive segment 72 and a spiral-shaped second conductive segment 74 symmetrical to a line L. The first conductive segment 72 and the second conductive segment 74 form at least an approximate circle pattern, and the line L is a diameter of the circle pattern. The inductor 70 further includes a second metal layer 78, and at least a dielectric layer (not shown) disposed between the second metal layer 78 and the first metal layer 72, 74. Portions of the first conductive segment 72 and the second conductive segment 74 are disposed above the second metal layer 78. Alternatively, in other embodiments of the present invention, the second metal layer 78 is disposed above the first metal layer 72, 74. As a result, portions of the first conductive segment 72 and the second conductive segment 74 are disposed under the second metal layer 78. The inductor 70 further includes a plurality of contact plugs 76, 80 penetrating through the dielectric layer to connect the first metal layer 72, 74 and the second metal layer 78. For example, the first conductive segment 72 comprises at least a first contact point, and the second conductive segment 74 comprises at least a second contact point. The first contact point of the first conductive segment 72 and the second contact point of the second conductive segment 74 are symmetrical to the line L. The contact plug 76 connects the first contact point of the first conductive segment 72 to a first end of the second metal layer 78. The contact plug 80 connects the second contact point of the second conductive segment 74 to a second end of the second metal layer 78.

Since the patterns of the first metal layer, the second metal layer and the contact plugs connecting the first metal layer and the second metal layer are symmetrical to the line, the inductor of present invention provides a fully symmetrical structure for the two differential signals (V+, V−) to improve the quality of the inductor and prevent the problems of phase noises. In addition, the present invention may further design rounded corners in the first conductive segment and the conductive segment of the first metal layer, thus preventing currents flowing through the inductor from collecting at the corners to increase local resistance and reduce the quality factor of the inductor. It is worth noticing that the inductor of the present invention is not limited to have the approximate circle pattern. Other inductor patterns comprising a plurality of metal layers, conductive segments and contact plugs symmetrical to a certain line are all applicable in the present invention.

In contrast to the asymmetrical inductor of the prior art, the present invention designs layout patterns of the inductor into a fully symmetrical structure. The first conductive segment and the second conductive segment of the first metal layer are disposed at either side of the line and symmetrical to the line. The third conductive segment and the fourth conductive segment of the second metal layer are disposed at either side of the line and symmetrical to the line. In addition, the contact plugs symmetrical to the line are also used to connect the first metal layer and the second metal layer. Therefore, the fully symmetrical inductor of the present invention can effectively prevent the problems of different parasitic resistance values, asymmetrical signals, phase differences and phase noises.

Those skilled in the art will readily observe that numerous modifications and alterations of the device may be made while retaining the teachings of the invention. Accordingly, the above disclosure should be construed as limited only by the metes and bounds of the appended claims.

The invention claimed is:

1. A symmetrical inductor comprising:

a first metal layer, the first metal layer comprising a first conductive segment disposed on a first side of a line, and a second conductive segment disposed on a second side of the line, the second conductive segment and the first conductive segment being symmetrical to the line, the first conductive segment comprising a first contact point, the second conductive segment comprising a second contact point, the first contact point and the second contact point being symmetrical to the line; and a dielectric layer, the dielectric layer comprising at least a first contact plug and a second contact plug, the first contact plug being used to connect the first contact point to a second metal layer, and the second contact plug being used to connect the second contact point to the second metal layer.

2. The symmetrical inductor of claim 1 wherein the first conductive segment and the second conductive segment form at least a circle pattern.

3. The symmetrical inductor of claim 2 wherein the line is a diameter of the circle pattern.

4. The symmetrical inductor of claim 1 wherein a portion of the first conductive segment overlaps the second metal layer.

5. The symmetrical inductor of claim 1 wherein a portion of the second conductive segment overlaps the second metal layer.

6. The symmetrical inductor of claim 1 wherein the first conductive segment comprises at least a rounded corner.

7. The symmetrical inductor of claim 1 wherein the second conductive segment comprises at least a rounded corner.

8. The symmetrical inductor of claim 1 wherein the second metal layer is disposed on the first side of the line and the second side of the line, both sides of the second metal layer being symmetrical to the line.

9. The symmetrical inductor of claim 1 wherein the second metal layer further comprises a third conductive segment disposed on the first side of the line, and a fourth conductive segment disposed on the second side of the line, the fourth conductive segment and the third conductive segment being symmetrical to the line.

* * * * *